US007726046B2

(12) United States Patent
Portnell

(10) Patent No.: US 7,726,046 B2
(45) Date of Patent: Jun. 1, 2010

(54) CLOCK SANDAL

(76) Inventor: Kara Portnell, 159 Martin Oaks Blvd., Eatonton, GA (US) 31024

( * ) Notice: Subject to any disclaimer, the term of this patent is extended or adjusted under 35 U.S.C. 154(b) by 157 days.

(21) Appl. No.: 12/080,564

(22) Filed: Apr. 4, 2008

(65) Prior Publication Data

US 2009/0249655 A1 Oct. 8, 2009

(51) Int. Cl.
*A43B 3/00* (2006.01)

(52) U.S. Cl. ..... 36/132; 36/11.5; 36/136; D2/916; D2/897

(58) Field of Classification Search ..... 36/50.1, 36/114, 89–92, 170, 45, 51–53; D2/916, D2/897, 941

See application file for complete search history.

(56) References Cited

U.S. PATENT DOCUMENTS 2,478,411 A * 8/1949 Martin ..... 36/1
4,471,539 A * 9/1984 Mann ..... 36/11.5
D285,142 S * 8/1986 McArthur ..... D2/905
4,649,552 A * 3/1987 Yukawa ..... 377/24
4,651,446 A * 3/1987 Yukawa et al. ..... 36/132
5,775,011 A * 7/1998 Reitano, Jr. ..... 36/136
5,921,008 A * 7/1999 Ruff ..... 36/136
6,094,844 A * 8/2000 Potts ..... 36/136
D436,049 S * 1/2001 Guadagno et al. ..... D10/70
6,278,378 B1 * 8/2001 Feiner et al. ..... 340/815.45
6,470,601 B1 * 10/2002 Zane ..... 36/132
6,870,796 B2 * 3/2005 Elling ..... 368/10
7,471,593 B2 * 12/2008 Loring ..... 368/10

* cited by examiner

*Primary Examiner*—Jila M Mohandesi

(57) ABSTRACT

Clock sandal with a flexible sole plate, a pair of flexible foot retaining straps, a time keeping device and a time keeping device retaining loop. The sole plate includes a thin flexible top layer of material. The sole heal portion includes a hollow cavity which is covered by a hinged top plate. The foot retaining straps are each attached to the left and right heal portion of the sole plate. The straps join to form a single strap that is fixedly connected to the portion of the sole plate that corresponds to the space between the wearer's big toe and second toe. The time keeping device retaining loop is fixedly attached to the single strap at the strap joining location and the time keeping device is frictionally retained within the time keeping device retaining loop.

3 Claims, 3 Drawing Sheets

CLOCK SANDAL

CROSS REFERENCE TO RELATED APPLICATIONS

Not applicable

STATEMENT REGARDING FEDERALLY SPONSORED RESEARCH OR DEVELOPMENT

Not applicable

DESCRIPTION OF ATTACHED APPENDIX

Not applicable

BACKGROUND OF THE INVENTION

This invention relates generally to the field of footwear and more specifically to a clock sandal.

Footwear known as sandals are well known. One sub-class of sandals are called flip-flops. These type of sandals are constructed of a flexible sole plate and a pair of straps that join at the front of the sole plate to form a single strap where the space between wearer's big toe and second toe can retain the strap and thereby hold the sandal onto the wearer's foot.

Flip-flop type sandals are often worn by people when going to the beach. During these occasions it is often necessary to carry items such as a time keeping device or keys. However, bathing suits and other beach attire often do not have pockets and having to carry a separate tote bag can also be inconvenient. Others have attempted to address this problem. For example, R. Lewis in her U.S. Pat. No. 7,028,422 discloses a slipper type shoe that includes a thin compartment to carry paper money or the like. D Weitzner in her U.S. Pat. No. 3,328,900 discloses an under the shoe sole plate that can be lifted to reveal a compartment for holding small items. And J Patrikios in his patent D370,112 discloses a show that includes a time piece built into the side of the shoe.

However there are deficiencies in the prior art because none of the previous patents discloses both a generous storage department accessible from the top heal portion of a flip-flop type sandal as well as a time keeping device built into the top portion of the sandal that can be easily read by the wearer while the sandals are in use by the wearer.

BRIEF SUMMARY OF THE INVENTION

The primary object of the invention is to provide a sandal that incorporates a time keeping device in the sandal so that a separate watch or other time keeping device does not need to be carried by the user.

Another object of the invention is to provide a sandal that incorporates a storage compartment so that a person can carry small items without having to carry an additional carrying case or clothing having pockets.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed clock sandal comprising: a flexible sole plate, a pair of flexible foot retaining straps, a time keeping device, a time keeping device retaining loop, said sole plate including a thin flexible top layer of material: said sole heal portion including a hollow cavity, said hollow cavity covered by a hinged top plate, said foot retaining straps each attached to the left and right heal portion of said sole plate and said straps joining to form a single strap that is fixedly connected to the portion of said sole plate that corresponds to the space between the wearer's big toe and second toe, said time keeping device retaining loop fixedly attached to said single strap at said strap joining location and said time keeping device frictionally retained within said device retaining loop.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
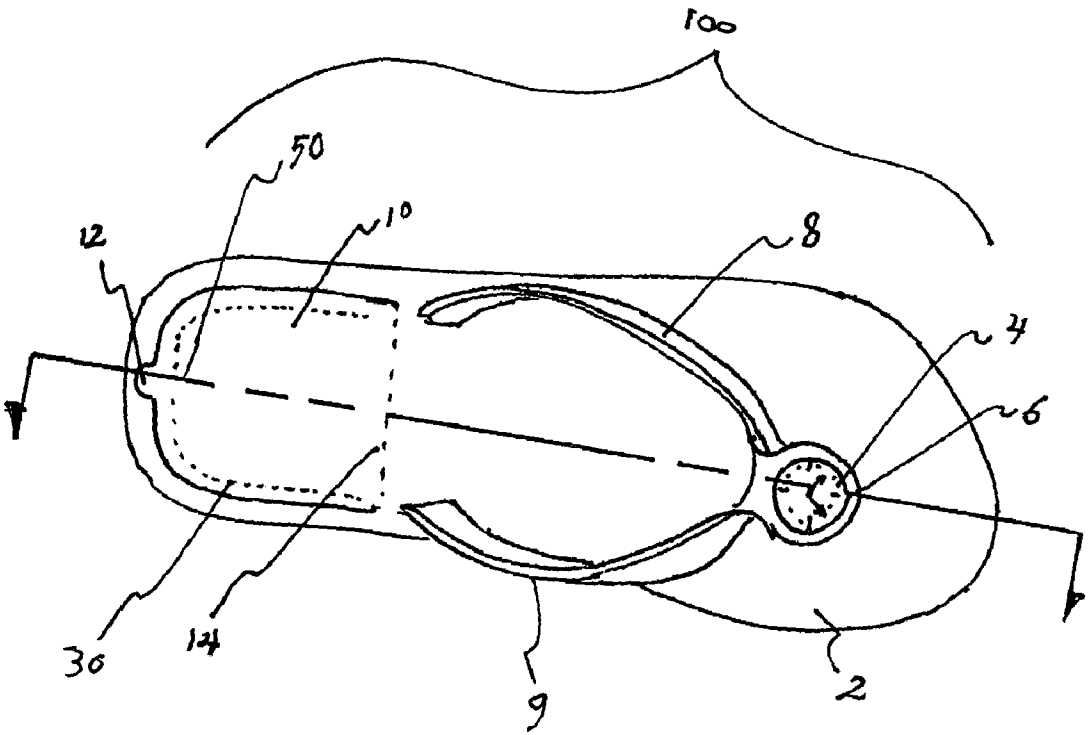
FIG. 1 is a top view of the invention.

Referring now to FIG. 1 we see a top view of the invention 100. The sandal is in many ways like a conventional flip-flop sandal that is well known. However, the heal portion includes a flat plate 10 that can be lifted to reveal a storage compartment underneath, the perimeter of which is described by dotted line 30. A thin layer of material 2 acts as a hinge member 14 for top plate 10. A person can easily open top plate 10 by grabbing tab 12 with thumb and forefinger and lifting. Straps 8, 9 are attached near the heal portion of the sandal in the standard way and join together to form a single strap at the location where the space between the wearer's big toe and second toe are located. The strap configuration is unique in that it includes a time keeping loop 6 that frictionally retains a standard time keeping device 4. In this way, the wearer does not need to wear a garment with pockets and does not need to carry a tote bag because both a time keeping device and a storage area for small items such as keys, credit cards or money are conveniently located in the wearer's sandal.

Figure 2:
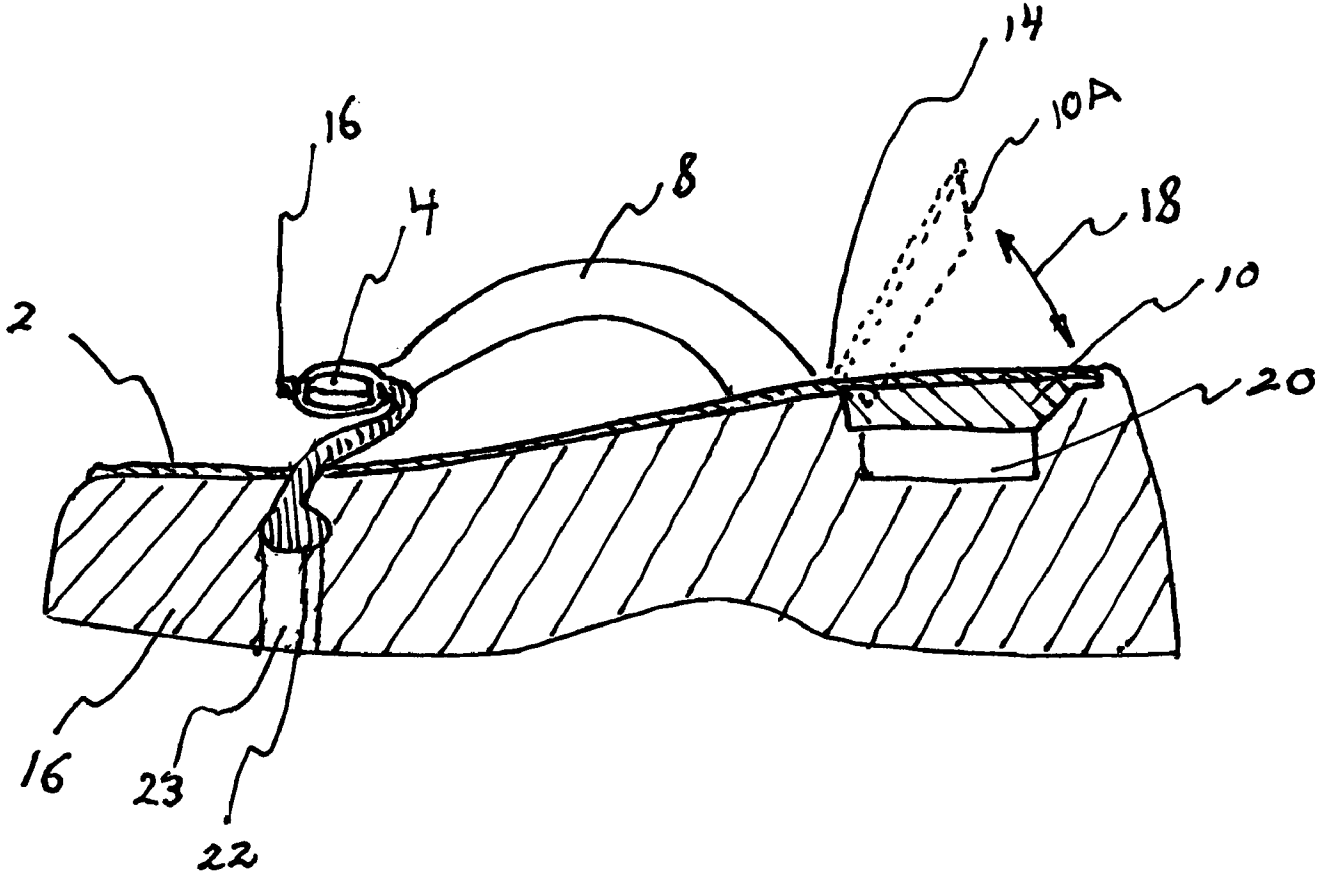
FIG. 2 is a side section view of the invention.
Figure 3:
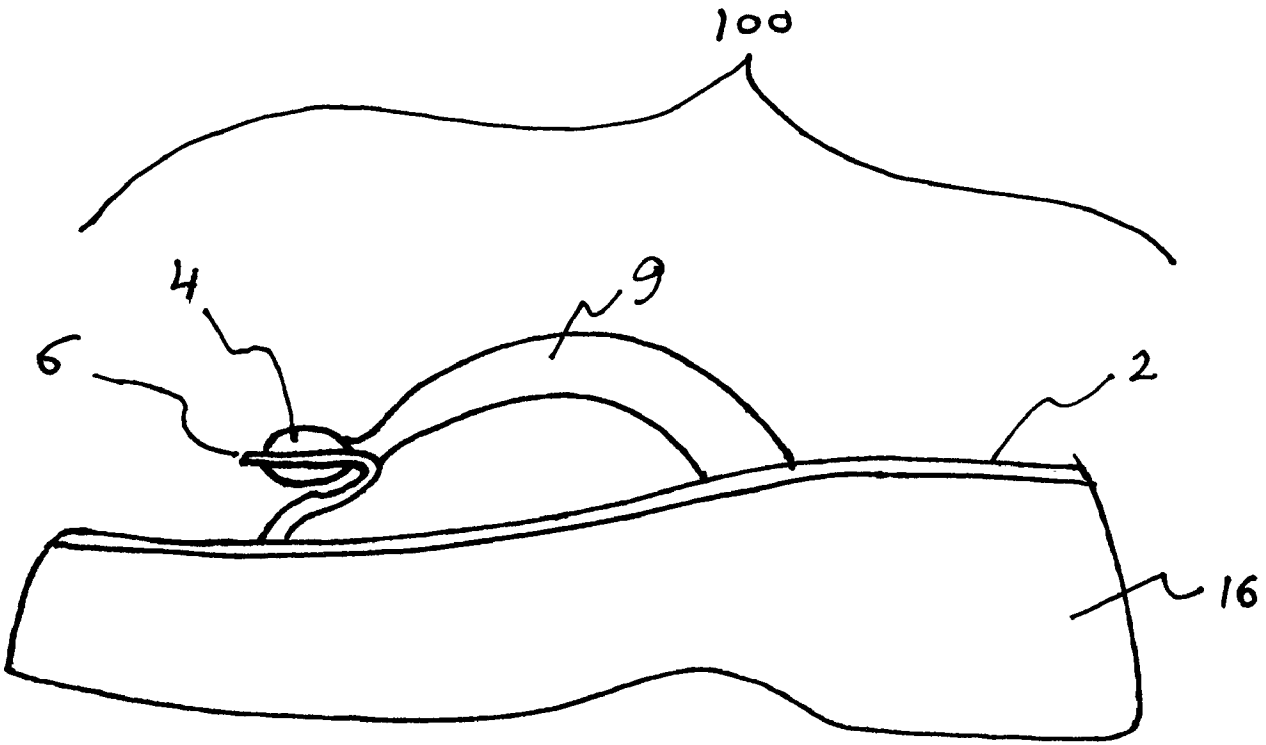
FIG. 3 is a side view of the invention.

FIG. 2 shows a side section view of the invention 100 as defined by section line 50 shown in FIG. 1. The section view clearly shows storage the cavity 20. The thin top layer of material 2 is bonded to the main portion of the sandal sole 16, The top layer of material 2 also acts as a hinge member 14 for storage plate top cover 10. Arrow 18 shows the ark of opening the top plate cover 10 and dotted line 10A shows the top plate cover 10 in its open position. Strap 8 joins strap 9 at the forward portion of the sandal and is retained by a bulbous portion 22 that has been slid into cylindrical socket 23. Time keeping member 4 is securely fitted in strap loop 16 and facing up toward the wearer so that the wearer can tell the time while walking. FIG. 3 is a side view of the sandal 100 and is shown for clarity purposes.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. clock sandal comprising:

a flexible sole plate;

a pair of flexible foot retaining straps;

a time keeping device;

a time keeping device retaining loop;

said sole plate including a thin flexible top layer of material:

said sole heal portion including a hollow cavity;

said hollow cavity covered by a hinged top plate;

said foot retaining straps each attached to the left and right heal portion of said sole plate and said straps joining to form a single strap that is fixedly connected to the portion of said sole plate that corresponds to the space between the wearer's big toe and second toe;

said time keeping device retaining loop fixedly attached to said single strap at said strap joining location and said time keeping device frictionally retained within said device retaining loop.

2. Clock sandal as claimed in claim 1 wherein said hinged top plate includes a lifting tab located at the opposite side of said hinge for said top plate portion.

3. Clock sandal as claimed in claim 1 wherein said flexible top layer of material also acts as said hinge member for said top plate.

* * * * *